US011293648B2

(12) United States Patent
Otsuka

(10) Patent No.: US 11,293,648 B2
(45) Date of Patent: Apr. 5, 2022

(54) COMPRESSOR COVER, OUTDOOR UNIT OF AIR-CONDITIONING APPARATUS, AND AIR-CONDITIONING APPARATUS

(71) Applicant: Mitsubishi Electric Corporation, Tokyo (JP)

(72) Inventor: Motoki Otsuka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 118 days.

(21) Appl. No.: 16/625,985

(22) PCT Filed: Aug. 23, 2017

(86) PCT No.: PCT/JP2017/030081

§ 371 (c)(1),
(2) Date: Dec. 23, 2019

(87) PCT Pub. No.: WO2019/038845

PCT Pub. Date: Feb. 28, 2019

(65) Prior Publication Data

US 2021/0003293 A1 Jan. 7, 2021

(51) Int. Cl.

| | |
|---|---|
| ***F24F 1/12*** | (2011.01) |
| ***F04B 39/00*** | (2006.01) |
| ***F24F 1/08*** | (2011.01) |
| ***F04B 39/12*** | (2006.01) |

(52) U.S. Cl.

CPC ..... *F24F 1/12* (2013.01); *F04B 39/0033* (2013.01); *F24F 1/08* (2013.01); *F04B 39/12* (2013.01); *F25B 2500/12* (2013.01)

(58) Field of Classification Search

CPC . F24F 1/12; F24F 1/08; F04B 39/0033; F04B 39/12; F04B 53/16; F04B 39/00; F25B 2500/12

USPC ..... 62/296

See application file for complete search history.

(56) References Cited

U.S. PATENT DOCUMENTS 6,062,033 A 5/2000 Choi

FOREIGN PATENT DOCUMENTS

| | | | | |
|---|---|---|---|---|
| EP | 2 949 934 | A2 | | 12/2015 |
| JP | S61-159773 | U | | 10/1986 |
| JP | H11-281098 | A | | 10/1999 |
| JP | 2001-165472 | A | | 6/2001 |
| JP | 2014-118905 | A | | 6/2014 |
| JP | 2014118905 | A | * | 6/2014 |
| JP | 2014-173769 | A | | 9/2014 |

(Continued)

OTHER PUBLICATIONS

International Search Report of the International Searching Authority dated Nov. 21, 2017 in corresponding International Patent Application No. PCT/JP2017/030081 (and English translation).

(Continued)

*Primary Examiner* — Steve S Tanenbaum
(74) *Attorney, Agent, or Firm* — Posz Law Group, PLC

(57) ABSTRACT

A compressor cover includes a side cover that surrounds a side peripheral surface of a compressor and a top cover provided above the compressor to cover along with the side cover, the compressor. The top cover has a first slope that extends such that an outer peripheral portion of the top cover is located lower than a central portion of the top cover.

11 Claims, 11 Drawing Sheets

(56) References Cited

FOREIGN PATENT DOCUMENTS

| | | | | |
|---|---|---|---|---|
| JP | 2014173769 | A | * | 9/2014 |
| JP | 2015-224824 | A | | 12/2015 |

OTHER PUBLICATIONS

Office Action dated Aug. 4, 2020 issued in corresponding JP patent application No. 2019-537473 (and English translation).
Chinese Office Action dated Apr. 12, 2021, issued in corresponding Chinese Patent Application No. 201780094039.6 (and English Machine Translation).
Extended European Search Report dated Apr. 20, 2020 issued in corresponding EP Patent Application No. 17922219.5.
Office Action dated Aug. 26, 2021, issued in corresponding CN Patent Application No. 201780094039.6 (and English Machine Translation).
Decision of Rejection dated Jan. 12, 2022 issued in corresponding CN Patent Application No. 201780094039.6 (and English Machine Translation).

* cited by examiner

COMPRESSOR COVER, OUTDOOR UNIT OF AIR-CONDITIONING APPARATUS, AND AIR-CONDITIONING APPARATUS

CROSS REFERENCE TO RELATED APPLICATION

This application is a U.S. national stage application of PCT/JP2017/030081 filed on Aug. 23, 2017, the contents of which are incorporated herein by reference.

TECHNICAL FIELD

The present invention relates to a compressor cover that covers a compressor, an outdoor unit of an air-conditioning apparatus, and the air-conditioning apparatus.

BACKGROUND ART

An outdoor unit of an air-conditioning apparatus includes an air-sending device chamber and a machine chamber adjacent to and separated from the air-sending device chamber by a partition. In the air-sending device chamber, for example, a fan is provided, and in the machine chamber, a compressor is provided. The compressor and heat exchangers are included in a refrigerant circuit. In general, refrigerant pipes connecting the compressor to the heat exchangers are extended and bent in an upper region located above the compressor, because the space for provision of components is limited.

In order to improve the functions of an air-conditioning apparatus, a larger heat exchanger and a larger fan are provided. Therefore, if the size of an outdoor unit is not changed, and the size of the air-sending device chamber is increased, inevitably, the size of the machine chamber is reduced. In addition, since a larger compressor is provided, refrigerant pipes are arranged at a higher density. In recent years, there has been a trend toward smaller outdoor units. Thus, refrigerant pipes are arranged in a narrow machine chamber in such a manner as to comply with various restrictions. In this case, the refrigerant pipes need to be extended and bent in the upper region located above the compressor.

As the number of refrigerant pipes provided above the compressor is increased, liquid such as dew condensation water generated on the refrigerant pipes more often drops on the compressor. It should be noted that a soundproofing cover is attached to the compressor such that it is wound around an outer peripheral portion of a body of the compressor. Also, another soundproofing cover is provided above the compressor (see, for example, Patent Literature 1). In general, the soundproofing covers are each formed to include a felt member intended for sound absorption and a rubber member intended for sound insulation.

Water dropping from the region located above the compressor falls on the soundproofing cover provided above the compressor. In this case, if a larger amount of liquid drops on the soundproofing cover, it may soak into the felt member of the soundproofing member, and stay in the felt member without evaporating.

If the soundproofing cover contains water, the compressor may rust, thus increasing the likelihood that the compressor will be perforated by corrosion and the likelihood that a thermistor provided to detect the surface temperature of a shell provided on an upper surface of the compressor will cause an error in detection.

CITATION LIST

Patent Literature

Patent Literature 1: Japanese Unexamined Patent Application Publication No. 11-281098

SUMMARY OF INVENTION

Technical Problem

The soundproofing cover disclosed in Patent Literature 1 is made based on the shape of a compressor. Therefore, it is necessary to design a new soundproofing cover each time the size or shape of the compressor is changed. Thus, it is harder to develop a soundproofing cover. In addition, it should be noted that compressors have each been made to have a larger number of components. Furthermore, soundproofing covers are each shaped to cover the entire compressor and to have a slope on an upper surface side of the compressor. However, because of variation in shape between soundproofing covers that is made when they are manufactured, and also variation in attachment between the soundproofing covers that is made when workers attach the soundproofing covers to respective compressors, the slopes of the soundproofing covers are located not to extend in an intended direction. That is, the soundproofing covers do not necessarily cause liquid dropping from the upper region to flow out in the intended direction.

The present invention has been made to solve the above problems, and an object of the invention is to provide a compressor cover that fits different types of compressors and can cause liquid dropping onto the cover to flow out in an intended direction, an outdoor unit of an air-conditioning-apparatus and the air-conditioning apparatus.

Solution to Problem

A compressor cover according to an embodiment of the present invention includes a side cover that surrounds a side peripheral surface of a compressor and a top cover that is provided above the compressor and covers along with the side cover, the compressor. The top cover has a first slope that extends such that an outer peripheral portion of the top cover is located lower than a central portion of the top cover.

An outdoor unit according to another embodiment of the present invention and included in an air-conditioning apparatus includes the above compressor cover.

An air-conditioning apparatus according to still another embodiment of the present invention includes the above outdoor unit.

Advantageous Effects of Invention

In the compressor cover, the outdoor unit of the air-conditioning apparatus, and the air-conditioning apparatus according to the embodiments of the present invention, the top cover has the first slope that extends such that the outer peripheral portion of the top cover is located lower than the central portion thereof. Thus, the top cover can be handled as a separate component independent of the side cover. Liquid dropping from an upper region located above the compressor can be guided by the first slope of the top cover and be then exhausted. The cover can be used for different types of compressors and enables liquid dropping from the upper region onto the cover to be exhausted in an intended direction.

DESCRIPTION OF EMBODIMENTS

Embodiments of the present invention will be described with reference to the drawings. It should be noted that in each of the figures, components that are the same as or equivalent to those in a previous figure are denoted by the same reference signs. The same is true of the entire text of the specification. Furthermore, the forms of components referred to in the entire text of the specification are described by way of example, and are not limited to those described in the text.

Embodiment 1

<Air-Conditioning Apparatus 100>

Figure 1:
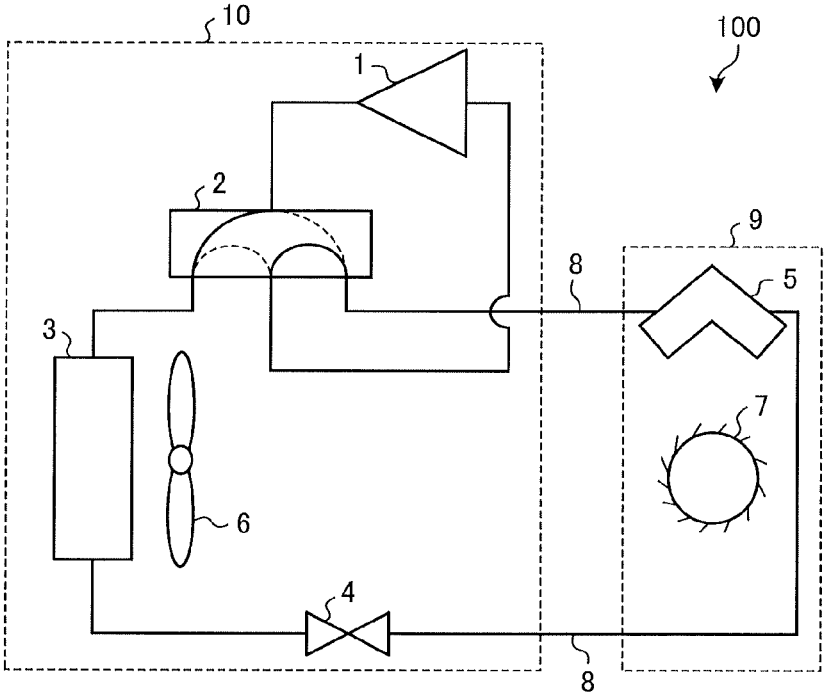
FIG. 1 is a schematic diagram illustrating the configuration of an air-conditioning apparatus according to Embodiment 1 of the present invention.

FIG. 1 is a schematic diagram illustrating the configuration of an air-conditioning apparatus 100 according to Embodiment 1 of the present invention. As illustrated in FIG. 1, in the air-conditioning apparatus 100, an outdoor unit 10 and an indoor unit 9 are connected to each other by refrigerant pipes 8. That is, the air-conditioning apparatus 100 includes the outdoor unit 10 for the air-conditioning apparatus 100.

The refrigerant pipes 8 connecting the outdoor unit 10 and the indoor unit 9 are filled with refrigerant to receive and transfer heat. The refrigerant is circulated between the outdoor unit 10 and the indoor unit 9, thereby cooling or heating space in which the indoor unit 9 is provided. As examples of the refrigerant, R32 and R410A can be applied.

The outdoor unit 10 includes a compressor 1, an outdoor heat exchanger 3, an expansion valve 4, a four-way valve 2, and an outdoor fan 6. The indoor unit 9 includes an indoor heat exchanger 5 and a cross-flow fan 7 that is an indoor fan.

<Outdoor Unit 10 of Air-Conditioning Apparatus 100>

Figure 2:
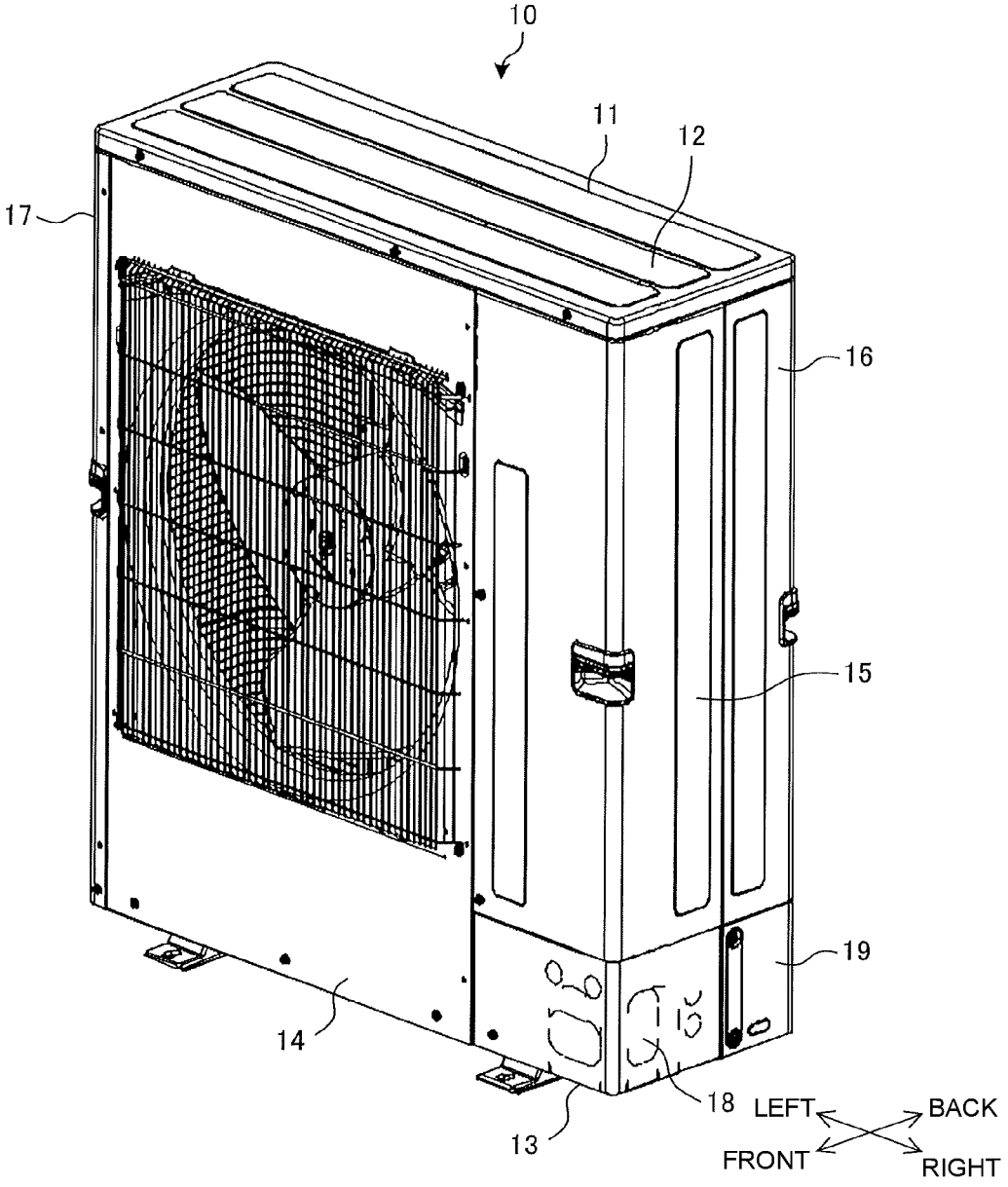
FIG. 2 is a perspective view of the appearance of an outdoor unit of the air-conditioning apparatus according to Embodiment 1 of the present invention.

FIG. 2 is a perspective view illustrating an appearance of the outdoor unit 10 of the air-conditioning apparatus 100 according to Embodiment 1 of the present invention. As illustrated in FIG. 2, the outdoor unit 10 includes a rectangular casing 11 that houses various components. The casing 11 of the outdoor unit 10 includes a top panel 12 at its top as viewed head-on from a front side of the casing. The casing 11 includes a base 13 at its bottom. The casing 11 includes a front panel 14 at its front. The casing 11 includes a service panel 15 that is extended from the front panel 14 and bent to the right side of the casing 11. The casing 11 includes a right side panel 16 on its right side as viewed from the front side. The casing 11 includes a left side panel 17 on its left side as viewed from the front side. The casing 11 includes a cover panel 18 located under the service panel 15. The casing 11 includes a cover panel 19 located under the right side panel 16.

Figure 3:
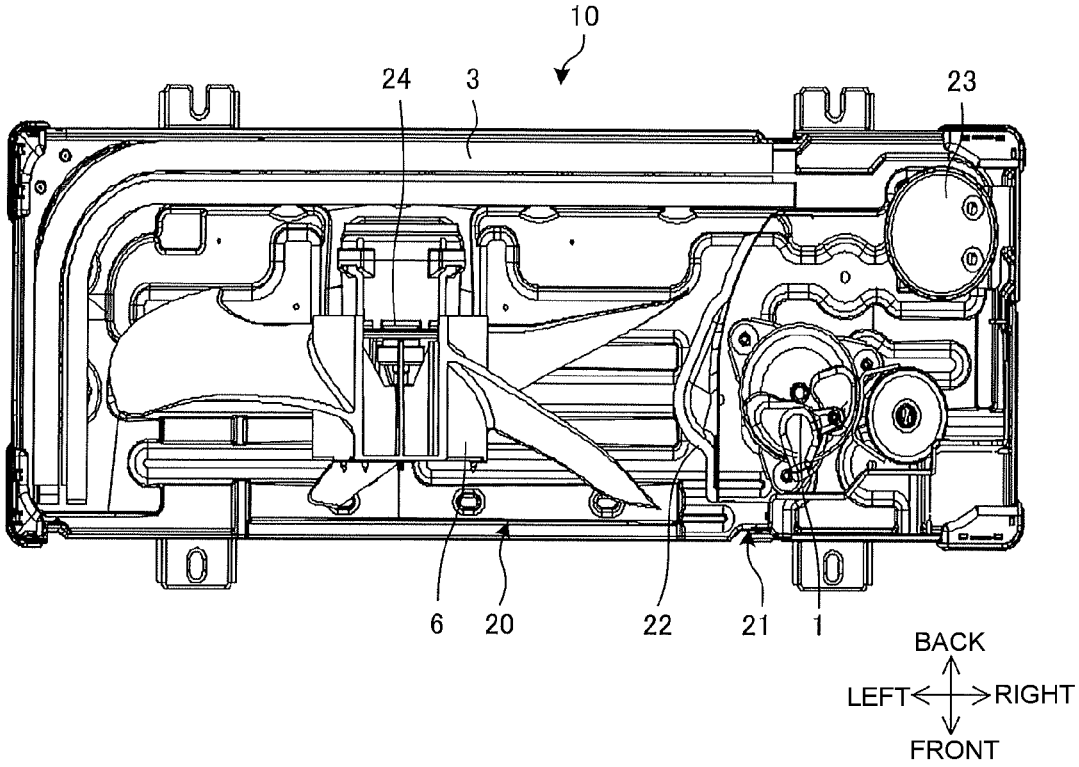
FIG. 3 is a diagram illustrating a cross section of the inside of the outdoor unit of the air-conditioning apparatus according to Embodiment 1 of the present invention.

FIG. 3 is a diagram illustrating a cross section of the inside of the outdoor unit 10 of the air-conditioning apparatus 100 according to Embodiment 1 of the present invention. It should be noted that FIG. 3 does not use hatching since the configuration of the section is complicated. As illustrated in FIG. 3, the outdoor unit 10 includes an air-sending device chamber 20 on a left side as viewed from the front side. The outdoor unit 10 includes a machine chamber 21 on a right side as viewed from the front side. The air-sending device chamber 20 and the machine chamber 21 are separated from each other by a separator 22.

In the machine chamber 21, the compressor 1, the refrigerant pipes (not illustrated), an electrical equipment box (not illustrated), a pressure vessel 23, and other components are provided. The refrigerant that flows into the machine chamber 21 through the refrigerant pipe 8 is sent to the compressor 1 through a refrigerant pipe 25.

The refrigerant is compressed by the compressor 1, passes through a discharge pipe 26, and is then sent to either the outdoor heat exchanger 3 or the indoor heat exchanger 5. For example, the electrical equipment box supplies power to components.

In the air-sending device chamber 20, the outdoor heat exchanger 3, the outdoor fan 6, a fan motor 24, a motor support (not illustrated), and other components are provided. The outdoor heat exchanger 3, which is L-shaped as viewed from above, is provided behind a rear side of the air-sending device chamber 20 located behind the outdoor fan 6. The fan motor 24 rotates and drives the outdoor fan 6. The motor support holds the fan motor 24 fixed.

<Soundproofing Cover 30 for Compressor 1>

Figure 4:
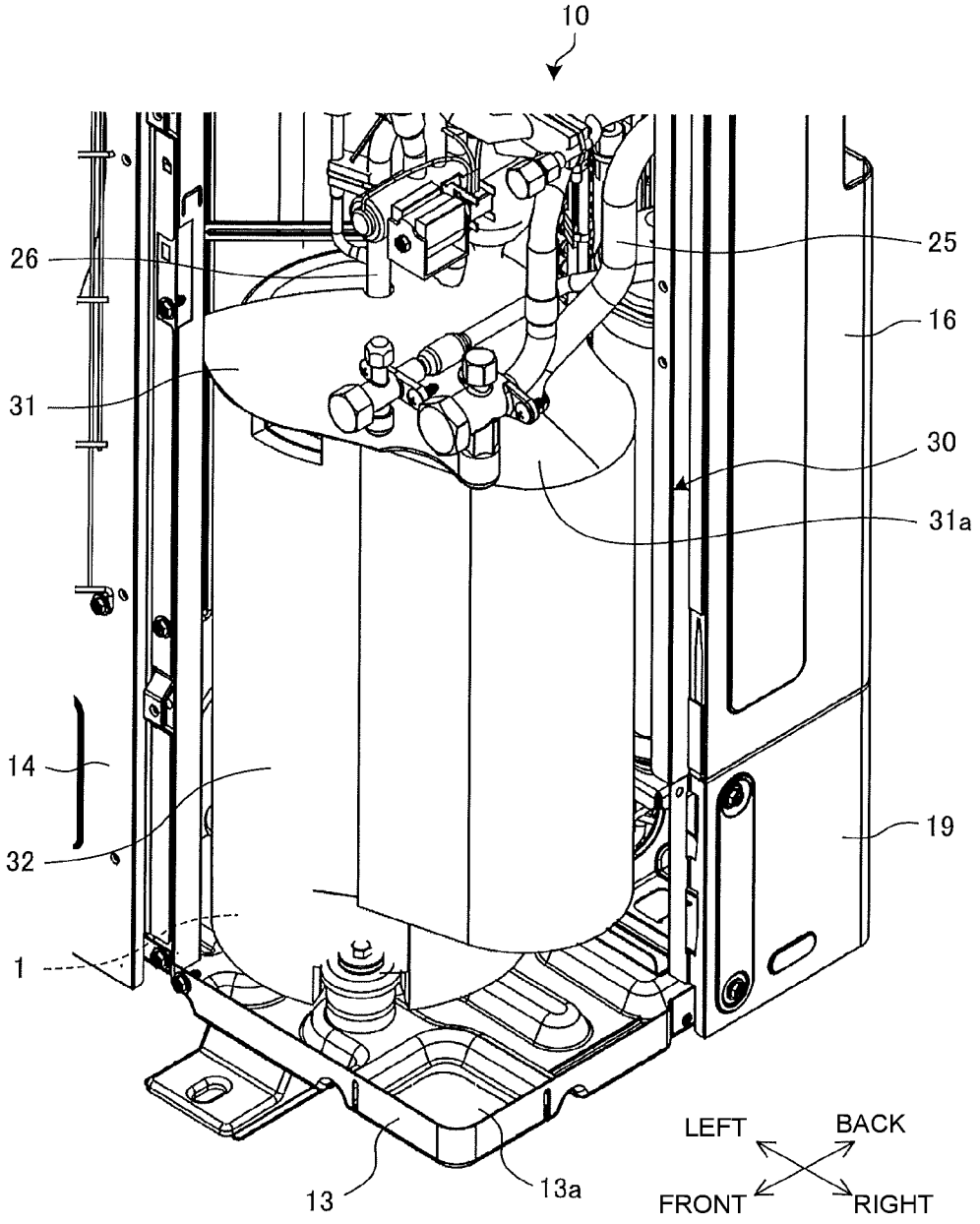
FIG. 4 is a perspective view illustrating a compressor with a top cover according to Embodiment 1 of the present invention, with the top cover attached to the compressor.

FIG. 4 is a perspective view illustrating the compressor 1 in the Embodiment 1 of the present invention, with a top cover 31 attached to the compressor 1. As illustrated in FIG.

4, the outdoor unit 10 of the air-conditioning apparatus 100 includes a soundproofing cover 30 that is a cover for the compressor 1. The soundproofing cover 30 is intended for soundproofing or sound insulation. The soundproofing cover 30 includes the top cover 31 and a side cover 32. The soundproofing cover 30 includes a felt member intended for sound absorption and a rubber member intended for sound insulation.

As illustrated in FIG. 4, the top cover 31 is located above the compressor 1 and covers together with the side cover 32, the compressor 1. The top cover 31 covers an outer periphery of part of the refrigerant pipe 25, which allows the refrigerant to flow into the compressor 1. The top cover 31 receives liquid such as dew condensation water that drops from the refrigerant pipe 25. An outer peripheral edge of the top cover 31 is located outward of an outer peripheral portion of the side cover 32 that covers a side peripheral surface of the compressor 1.

The top cover 31 has a first slope 31*a* that inclines downwards such that an outer peripheral portion of the top cover 31 is located lower than a central portion thereof. The first slope 31*a* is a slope that guides liquid, such as dew condensation water, generated on an outer surface of the refrigerant pipe 25 and then dropping on the top cover 31, such that the liquid flows toward a drain exhaust passage 13*a* of the base 13. The base 13 is a bottom plate of the casing on which the compressor 1 is provided. It should be noted that as illustrated in FIG. 4, the first slope 31 is inclined toward the right side of the outdoor unit 10. The drain exhaust passage 13*a* of the base 13 is located at a place to which water freely falls down from the first slope 31*a*.

<Part of Soundproofing Cover 30 which is Other than Top Cover 31>

Figure 5:
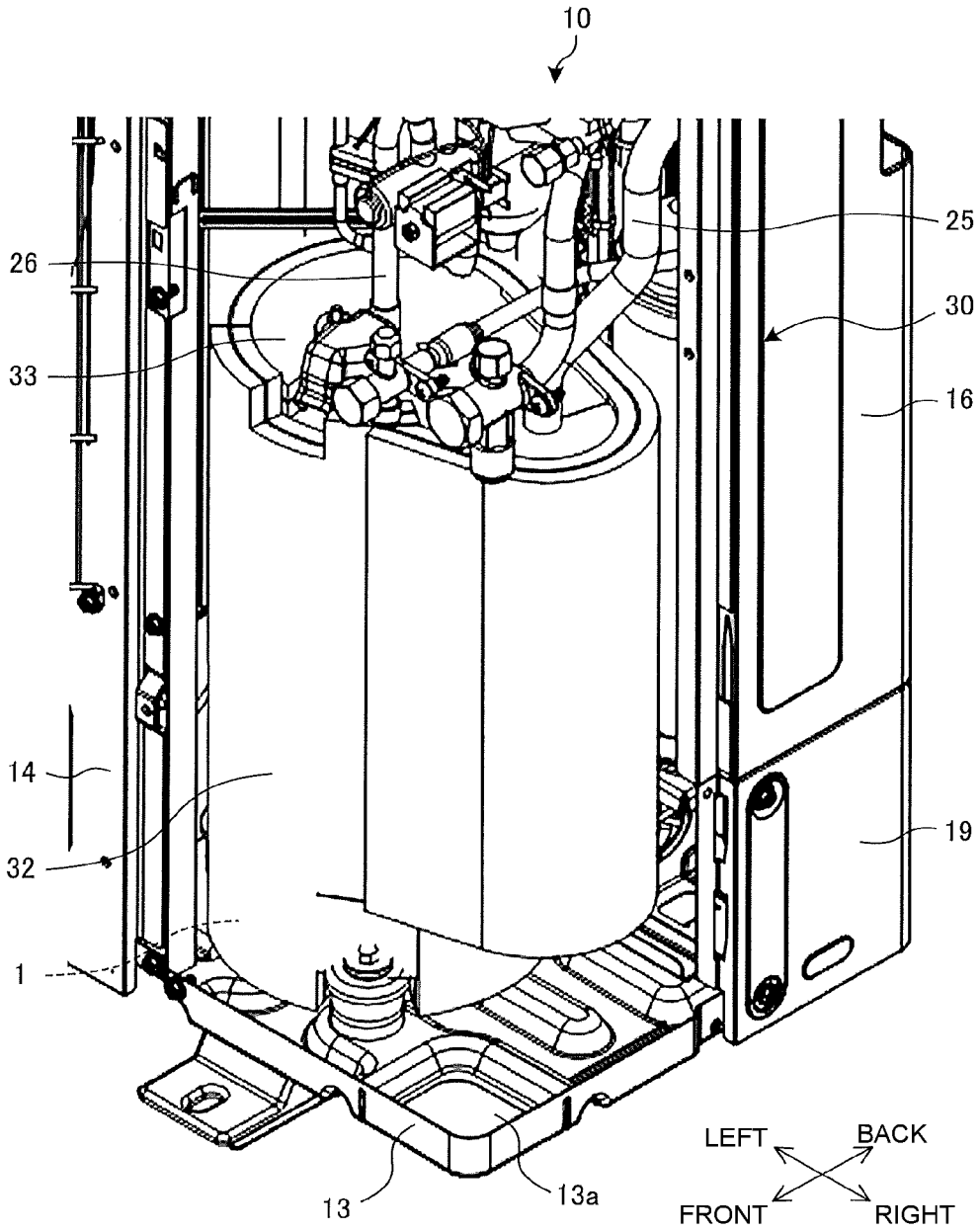
FIG. 5 is a perspective view illustrating the compressor, with the top cover according to Embodiment 1 of the present invention removed.

FIG. 5 is a perspective view illustrating the compressor, with the top cover 31 according to Embodiment 1 of the present invention removed. As illustrated in FIG. 5, the side cover 32 surrounds the side peripheral surface of the compressor 1 such that the side cover 32 is wound around an outer peripheral portion of the body of the compressor 1. The soundproofing cover 30 includes an inner cover 33 that is located on an inner side of the top cover 31 and above the compressor 1. The inner cover 33 covers together with the side cover 32, the compressor 1. The inner cover 33 also covers the entire upper part of an inner peripheral portion of the side cover 32. An upper surface of the inner cover 33 is covered by the top cover 31, and liquid dropping from the refrigerant pipe 25 is thus reliably received by the top cover 31 without falling on the inner cover 33.

<State of Top Cover 31 Before Attachment>

Figure 6:
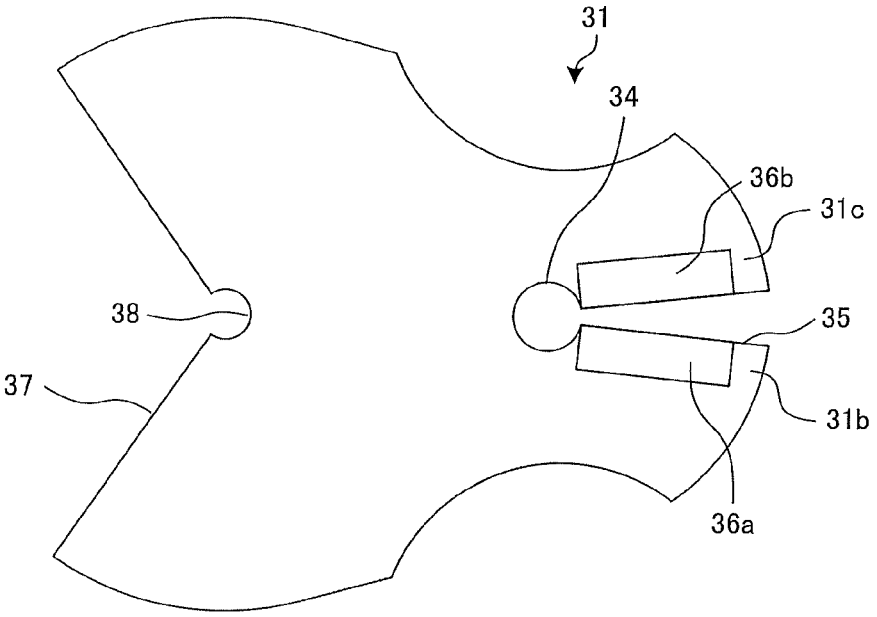
FIG. 6 is a top view of the top cover according to Embodiment 1 of the present invention before attachment of the top cover.
Figure 7:
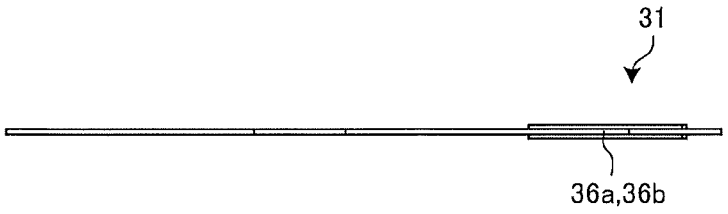
FIG. 7 is a side view of the top cover according to Embodiment 1 of the present invention before attachment of the top cover.
Figure 8:
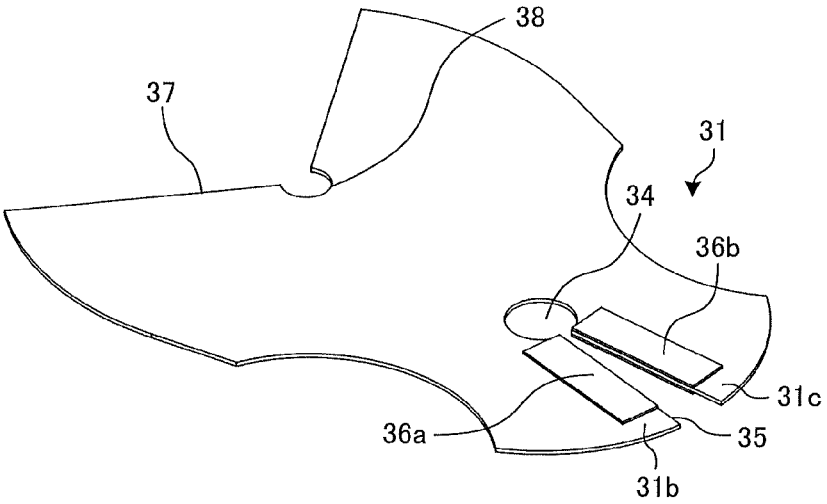
FIG. 8 is a perspective view of the top cover according to Embodiment 1 of the present invention before attachment of the top cover.

FIG. 6 is a top view of the top cover 31 according to Embodiment 1 of the present invention before attachment of the top cover 31. FIG. 7 is a side view of the top cover 31 according to Embodiment 1 of the present invention before attachment of the top cover 31. FIG. 8 is a perspective view of the top cover 31 according to Embodiment 1 of the present invention before attachment of the top cover 31.

As illustrated in FIGS. 6 and 8, the top cover 31 has a first hole portion 34 that surrounds the refrigerant pipe 25 that extends upwards from the compressor 1. The first hole portion 34 has an inside diameter that is equivalent to an outside diameter of the refrigerant pipe 25.

As illustrated in FIGS. 6 and 8, the top cover 31 has a first cut portion 35 that extends between the first hole portion 34 and an outer peripheral side of the first cover 31. When both side portions 31*b* and 31*c* of the first cut portion 35 are still not made to overlap each other, the first cut portion 35 has a gap between both sides of the first cut portion 35 on the outer peripheral side. In Embodiment 1, the width of the gap of the first cut portion 35 increases from the first hole portion 34 toward the outer peripheral side. Edge portions of the both side portions 31*b* and 31 of the first cut portion 35 linearly extend.

As illustrated in FIG. 7, the top cover 31 is flat when the both side portions 31*b* and 31*c* of the first cut portion 35 are still not made to overlap each other. Thus, the top cover 31 can be easily formed by stamping, for example, a rubber sheet.

As illustrated in FIGS. 6 to 8, the top cover 31 includes a pair of hook-and-loop fasteners 36*a* and 36*b* that are provided on the both side portions 31*b* and 31*c* of the first cut portion 35, and are used when the both side portions 31*b* and 31*c* of the first cut portion 35 are made to overlap each other, such that the first slope 31*a* is provided. The pair of hook-and-loop fasteners 36*a* and 36*b* are rectangular. The pair of hook-and-loop fasteners 36*a* and 36*b* can be easily attached to and detached from each other. The pair of hook-and-loop fasteners 36*a* and 36*b* extend along edges of the both side portions 31*b* and 31*c* of the first cut portion 35 that extends between the first hole portion 34 and the outer peripheral side, and the hook-and-loop fasteners 36*a* and 36*b* each have a length greater than or equal to at least half the lengths of the edges. The fasteners may be extended over the entire edges. When the both side portions 31*b* and 31*c* of the first cut portion 35 are made to overlap each other, and the pair of hook-and-loop fasteners 36*a* and 36*b* are made to cling to each other, the first slope 13 is formed, and the pair of hook-and-loop fasteners 36*a* and 36*b* hold formation of the first slope 31*a*. The hook-and-loop fasteners 36*a* and 36*b* can be easily attached to and detached from each other, and it is possible to change the manner in which the hook-and-loop fasteners 36*a* and 36*b* are attached to each other. It is therefore possible to change the gradient of the first slope 31*a*.

As illustrated in FIGS. 6 and 8, the top cover 31 has a notch 37 in a region that is different from a region including the first slope 31*a* and that contacts the discharge pipe 26 extending upwards from the compressor 1. The notch 37 is formed in the shape of a sector. The notch 37 is located for the discharge pipe 26 that extends upwards from the compressor 1 and in a region opposite to the refrigerant pipe 25 that extends upwards from the compressor 1. The notch 37 includes a second hole portion 38 that has an inside diameter equivalent to an outside diameter of the discharge pipe 26. It should be noted that liquid easily adheres to a lower portion of the refrigerant pipe 25, which is located on a lower-pressure side of the compressor 1, and which allows the refrigerant to flow into the compressor 1. Therefore, it is not indispensable that the soundproofing cover 30 covers the entire upper surface of the compressor 1. That is, the top cover 31 has only to cover only part of the upper surface of the compressor 1 that should be covered, and the notch 37 can thus be formed. Thus, the cost of the material of the top cover 31 is reduced, and the manufacturing cost of the top cover 13 is also reduced.

The top cover 31 is made of a hydrophobic or water-repellent material. As the material of the top cover 31, for example, rubber is superior to other materials.

<State of Top Cover 31 after Attachment>

Figure 9:
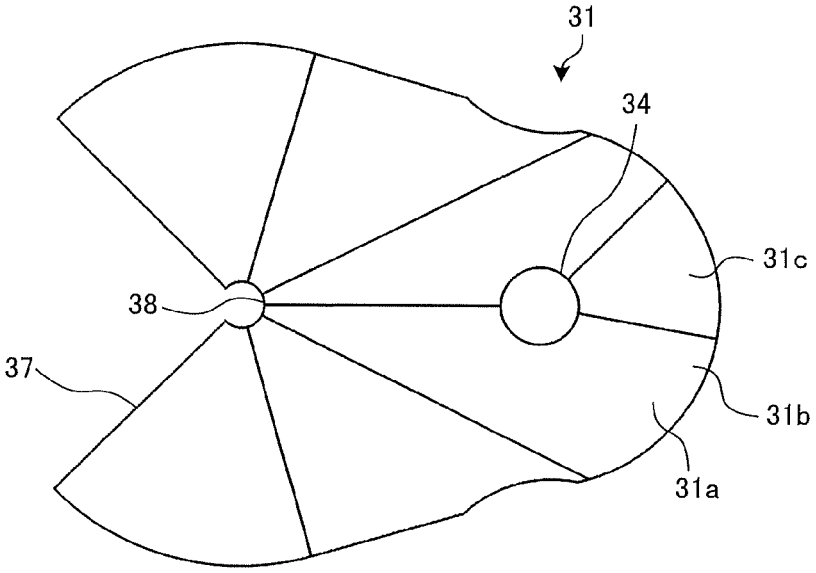
FIG. 9 is a top view of the top cover according to Embodiment 1 of the present invention after attachment of the top cover.
Figure 10:
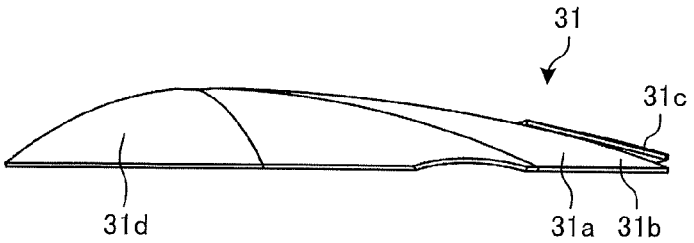
FIG. 10 is a side view of the top cover according to Embodiment 1 of the present invention after attachment of the top cover.
Figure 11:
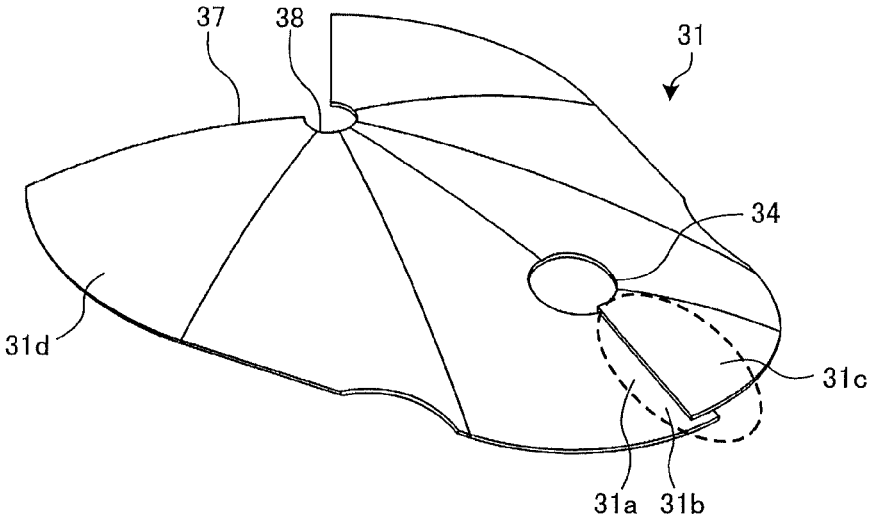
FIG. 11 is a perspective view of the top cover according to Embodiment 1 of the present invention after attachment of the top cover.

FIG. 9 is a top view of the top cover 31 according to Embodiment 1 of the present invention after attachment of the top cover 31. FIG. 10 is a side view of the top cover 31 according to Embodiment 1 of the present invention after attachment of the top cover 31. FIG. 11 is a perspective view of the top cover 31 according to Embodiment 1 of the present invention after attachment of the top cover 31.

As illustrated in FIGS. 9 to 11, the first slope 31*a* is provided by causing the both side portions 31*b* and 31*c* of the first cut portion 35 of the top cover 31 to overlap each other. To be more specific, the both side portions 31*b* and 31*c* of the first cut portion 35 are made to overlap each other such the pair of hook-and-loop fasteners 36*a* and 36*b* are made to cling to each other.

When the both side portions 31*b* and 31*c* of the first cut portion 35 are made to overlap each other, the first hole portion 34 of the top cover 31 surrounds the entire outer periphery of part of the refrigerant pipe 25. Since the top cover 31 surrounds the entire periphery of the part of the refrigerant pipe 25, liquid is prevented from dropping into a region located under the top cover 31 while flowing down over the refrigerant pipe 25.

Also, when the both side portions 31*b* and 31*c* of the first cut portion 35 are made to overlap each other and the first slope 31*a* is provided, the shape of the entire top cover 31 is changed from a flat plate-shape to a dome shape. That is, the top cover 31 is shaped to have a slope 31*d* in addition to the first slope 31*a*, such that the entire upper surface of the top cover 31 is curved as illustrated in FIGS. 10 and 11. As a result, even if dropping onto any portion of the top cover 31, liquid is rapidly made to flow to the outside of the top cover 31.

Figure 12:
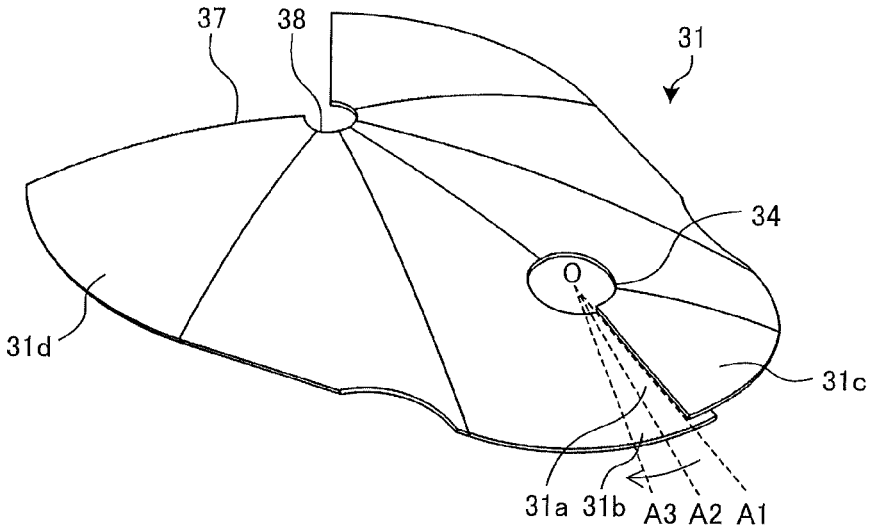
FIG. 12 is a diagram indicating lines inclined at the maximum tilt angle on the top cover according to Embodiment 1 of the present invention, after attachment of the top cover.

FIG. 12 is a diagram indicating lines inclined at the maximum tilt angle on the top cover 31 according to Embodiment 1 of the present invention, after attachment of the top cover 13. As illustrated in FIG. 12, the top cover 31 is formed such that an imaginary line A1, A2, or A3 that inclines at the maximum tilt angle is located in a given area of the side portion 31*c* that is a lower one of the both side portions 31*b* and 31*c* of the first cut portion 35 when the both side portions overlap each other. In this case, in the above area of the side portion 31, the boundary between the both side portions 31*b* and 31*c* is also located. The maximum tilt angle means a maximum angle at which the first slope 31*a* is inclined relative to a horizontal plane, which extends between the first hole portion 34 and the outer peripheral side. The first slope 31*a* is inclined at the maximum tilt angle in such a manner as to extend toward the drain exhaust passage 13*a* included in the base 13, to thereby cause liquid to be rapidly exhausted.

In Embodiment 1, the imaginary line A1 inclined at the maximum tilt angle is located at the boundary between the both side portions 31*b* and 31*c* of the first cut portion 35 when the both side portions 31*b* and 31*c* overlap with each other. However, in the top caver 31, it suffices that as described above, the imaginary line A1, A2 or A3 inclined at the maximum tilt angle is located on the portion 31*b* that is a lower one of the overlapping side portions of the top cover 31. Thus, as illustrated in FIG. 12, the imaginary line inclined at the maximum tilt angle may be set at the position of the imaginary line A2 or A3.

Although it is not illustrated, the top cover 31 may have the second hole portion 38 that surrounds the discharge pipe 26 extending upwards from the compressor 1. Also, the top cover 31 may have a second cut portion (not illustrated) that is provided between the second hole portion 38 and the peripheral side. Furthermore, the top cover 31 may have a second slope (not illustrated) provided by causing both side portions of the second cut to overlap each other. It is appropriate that the second slope is located opposite to the first slope 31*a*.

<Advantages of Embodiment 1>

According to Embodiment 1, the soundproofing cover 30 for the compressor 1 includes the side cover 32 that surrounds the side peripheral surface of the compressor 1. The soundproofing cover 30 for the compressor 1 includes the top cover 31 provided above the compressor 1 to cover together with the side cover 32, the compressor 1. The top cover 31 has the first slope 31*a*, as a result of which the outer peripheral portion of the top cover 31 is located lower than the central portion thereof.

In the configuration, the top cover 31 can be handled as a separate component independent of the side cover 32. Thereby, attachment and detachment of the top cover 31 can be easily performed, thus improving the workability. In addition, it is possible to easily adjust the gradient of the first slope 31*a*, which guides liquid that drops onto the top cover 31. Furthermore, in the case where the top cover 31 is discarded, it can be easily separated from the side cover. This is environmentally friendly. In addition, ordinarily, the top cover 31 is not affected by the change of the size or shape of the compressor 1, and can thus be used for different types of compressors 1. Even if a new type of compressor 1 is provided, it is not necessary to make a new top cover 31 for the new type of compressor 1. Furthermore, even if liquid such as dew condensation water on the refrigerant pipe 25 located above the compressor 1 drops onto the top cover 31, the liquid is guided by the first slope 31*a* of the top cover 31 and is then exhausted. The top cover 31 prevents the compressor 1 from being moistened by the liquid dropping from above. Thereby, it is possible to prevent the compressor 1 from rusting, thereby preventing false detection of a sensor that detects the temperature of a shell on the compressor 1 or a failure of the sensor. Furthermore, the top cover 31 can achieve sound insulation or sound absorption as in existing top covers. Thus, the top cover 31 can be used for various types of compressors 1, and enables liquid dropping from above to be exhausted in an intended direction.

According to Embodiment 1, the top cover 31 has the first hole portion 34 that surrounds the refrigerant pipe 25 extending upwards from the compressor 1. The top cover 31 has the first cut portion 35 that is provided between the first hole portion 34 and the outer peripheral side. The first slope 31*a* is provided by causing the both side portions 31*b* and 31*c* of the first cut portion 35 of the top cover 31 to overlap each other.

In the above configuration, attachment of the top cover 31, which is a separate component, is performed simply by causing the both side portions 31*b* and 31*c* of the first cut portion 35 to overlap each other. Thus, attachment and detachment of the top cover 31 can be easily performed, thus improving the workability. In addition, the gradient of the first slope 31*a*, which guides liquid dropping from an upper region located above the top cover 31, can be easily adjusted. Furthermore, the top cover 31 can be easily separated when discarded, and is thus environmentally friendly. In addition, even if the size or shape of the compressor 1 is changed, ordinarily, the top cover 31 is not affected by the change, and can be used for various types of compressors 1. Thus, even for a given type of compressor 1 different from the above compressor 1, the top cover 31 can be applied as it is, and it is not necessary to make a new top cover 31. Furthermore, in the top cover 31, the first hole portion 34 surrounds the refrigerant pipe 25 extending upwards from the compressor 1, and thus even if liquid such as dew condensation water at the refrigerant pipe 25 located above the compressor 1 drops onto the top cover 31 the liquid is guided by the first slope 31*a* of the top cover 31 and then exhausted without flowing into the region under the top cover 31 through the first hole portion 34 of the top cover 31.

According to Embodiment 1, the outer peripheral edge of the top cover 31 is located outward of the outer peripheral portion of the side cover 32.

In the above configuration, the top cover 31 is larger than the side cover 32 as seen in plan view. Thus, liquid dropping from the upper region onto the top cover 31 is exhausted to the outside of the top cover 31 without flowing into a region located inward of the side cover 32. Furthermore, the top cover 31 does not need to be engaged with the side cover 32. Thus, ordinarily, the top cover 31 is not affected by the change of the size or shape of the compressor 1, and can be used for different types of compressors 1. Even if a given type of compressor 1 different from the above compressor 1 is applied, the top cover 1 can be still used, that is, a new top cover 1 does not need to be made as a specific one for the other kind of compressor 1.

According to Embodiment 1, the first cut portion 35 has a gap between the both side portions 31*b* and 31*c* on the outer peripheral side, while the both side portions 31*b* and 31*c* of the first cut portion 35 do not overlap each other.

In the above configuration, in the top cover 31, the first slope 31*a* can be formed simply by causing the both side portions 31*b* and 31*c* of the first cut portion 35 to overlap each other.

According to Embodiment 1, the top cover 31 includes the pair of hook-and-loop fasteners 36*a* and 36*b* on the both side portions 31*b* and 31*c* of the first cut portion 35. When the both side portions 31*b* and 31*c* of the first cut portion 35 are made to overlap each other, the first slope 31*a* is formed.

In the above configuration, when the pair of hook-and-loop fasteners 36*a* and 36*b* are made to cling to each other, the both side portions 31*b* and 31*c* of the first cut portion 35 overlap each other, thus forming the first slope 31*a*. In such a manner, attachment and detachment of the top cover 31 are easily performed, and it is possible to easily adjust a direction in which the first slope 31*a* slopes. In addition, the workability in attachment of the top cover 31 is good.

According to Embodiment 1, the pair of hook-and-loop fasteners 36*a* and 36*b* are formed to extend along edge portions of the first cut portion 35 provided between the first hole portion 34 and the outer peripheral side and each have a length greater than or equal to half each of the lengths of the edge portions.

In the above configuration, it is possible to improve the clingingness of the pair of hook-and-loop fasteners 36*a* and 36*b*. Furthermore, when made to overlap each other, the both side portions 31*b* and 31*c* of the first cut portion 35 more tightly contact each other, thus reliably preventing liquid guided over the first slope 31*a* from flowing from the overlapping side portions and the first cut portion 35 into the region located under the top cover 31.

According to Embodiment 1, in the top cover 31, the imaginary line A1, A2, or A3 that extends between the first hole 34 of the first slope 31*a* and the outer peripheral side and inclines at the maximum tilt angle relative to the horizontal plane is located in a given area of the side portion 31*b* that is one of the both side portions 31*b* and 31*c* of the first cut portion 35 when the both side portions 31*b* and 31*c* overlap each other. In the above area of the portion 31*b*, the boundary between the both side portions 31*b* and 31*c* of the first cut portion 35 is also located.

In the above configuration, when liquid that drops from the upper region onto the top cover 31 is guided by the first slope 31*a* which inclines at the maximum tilt angle, and passes through the overlapping portion of the both side portions 31*b* and 31*d* of the first cut portion 35, the liquid is guided from the side portion 31*c*, which is an upper one of the both side portions 31*b* and 31*d*, onto the side portion 31*b*, which is a lower one of the both side portions 31*b* and 31*d*. Thus, at the overlapping portion of the both side portions 31*b* and 31*c* of the first cut portion 35, the edge of the side portion 31*c*, which is the upper side portion, slopes downwards along the imaginary line A1, A2, or A3 at the maximum tilt angle, and the liquid guided over the first slope 31*a* does not flow into the region located under the top cover 31 through the first cut portion 35.

According to Embodiment 1, the top cover 31 has the notch 37 in the region that is different from the region including the first slope 31*a* and that contacts the discharge pipe 26 extending upwards from the compressor 1.

In the above configuration, in the vicinity of the discharge pipe 26, there is a region in which the top cover 31 is not located. On the discharge pipe 26, liquid such as dew condensation water is not generated, since the refrigerant compressed by the compressor 1 is discharged through the discharge pipe 26. Therefore, the size of the top cover 31 can be reduced, thus reducing the manufacturing cost.

According to Embodiment 1, the top cover 31 has the second hole portion 38 that surrounds the discharge pipe 26 extending upwards from the compressor 1. Also, the top cover 31 has the second cut portion which is provided between the second hole portion 38 and the outer peripheral side. Furthermore, the top cover 31 has the second slope that is provided by causing the both side portions of the second cut portion to overlap each other.

In the above configuration, even if liquid should be generated on the discharge pipe 26 or move toward the discharge pipe 26, since the top cover 31 covers the discharge pipe 26, the liquid would be guided to the second slope and be exhausted, and thus would not flow into the region located under the top cover 31.

According to Embodiment 1, the second slope is located opposite to the first slope 31*a*.

In the above configuration, if liquid should be generated on the discharge pipe 26 or be moved toward the discharge pipe 26, the liquid would be guided to the second slope, i.e., it would be guided in an unintended direction, and be exhausted.

According to Embodiment 1, the first slope 31*a* is a slope that guides liquid received by the top cover 31 toward the drain exhaust passage 13*a* of the base 13 that is a bottom plate of the casing, on which the compressor 1 is provided.

In the above configuration, even if liquid such as dew condensation water on the refrigerant pipe 25 located above the compressor 1 drops onto the top cover 31, the liquid is guided over the first slope 31*a* of the top cover 31 toward the drain exhaust passage 13*a* and is exhausted to the drain exhaust passage 13*a*.

According to Embodiment 1, the top cover 31 is made of a hydrophobic or water-repellent material.

Therefore, when liquid such dew condensation water on the refrigerant pipe 25 provided above the compressor 1 drops onto the top cover 31, the liquid is guided over the first slope 31*a* of the top cover 31 without being absorbed by the top cover 31.

According to Embodiment 1, the outdoor unit 10 of the air-conditioning apparatus 100 includes the soundproofing cover 30 for the compressor 1.

In the above configuration, the soundproofing cover 30 for the compressor 1 includes the top cover 31. Thus, the top cover 31 can be handled as a separate component. Liquid dropping from the upper region located above the compressor 1 is guided by the first slope 31*a* of the top cover 31 and is then discharged. In such a configuration, the soundproofing cover 30 can be used for different types of compressors 1, and enables liquid dropping onto the cover to be exhausted in an intended direction.

According to Embodiment 1, the air-conditioning apparatus 100 includes the outdoor unit 10.

In the above configuration, the outdoor unit 10 of the air-conditioning apparatus 100 includes the soundproofing cover 30 for the compressor 1. The soundproofing cover 30 for the compressor 1 includes the top cover 31. Thus, the top cover 31 can be handled as a separate component. Liquid that drops from the region located above the compressor 1 is guided over the first slope 31*a* of the top cover 31 and is then exhausted. Thus, the soundproofing cover 30 can be used for different types of compressors 1, and enables liquid dropping from the above region to be exhausted in an intended direction.

Embodiment 2

<Soundproofing Cover 30 for Compressor 1>

Figure 13:
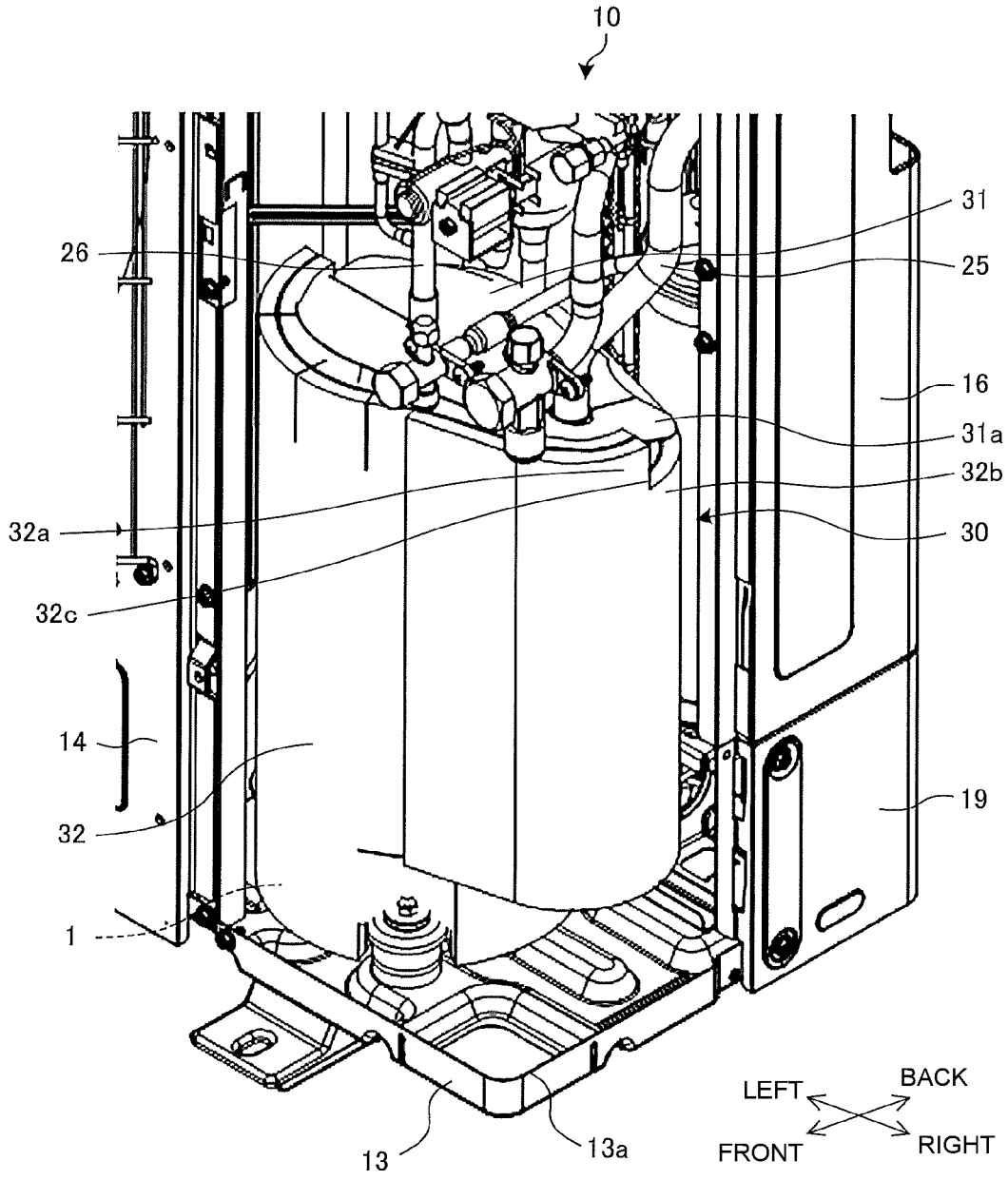
FIG. 13 is a perspective view illustrating a top cover according to Embodiment 2 of the present invention after attachment of the top cover.
Figure 14:
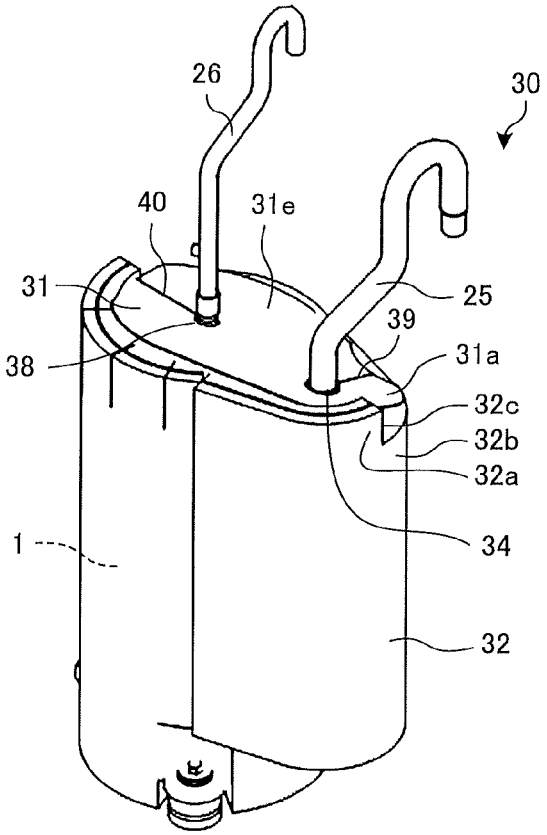
FIG. 14 is an enlarged perspective view illustrating a compressor with the top cover according to Embodiment 2 of the present invention, with the top cover attached to the compressor.
Figure 15:
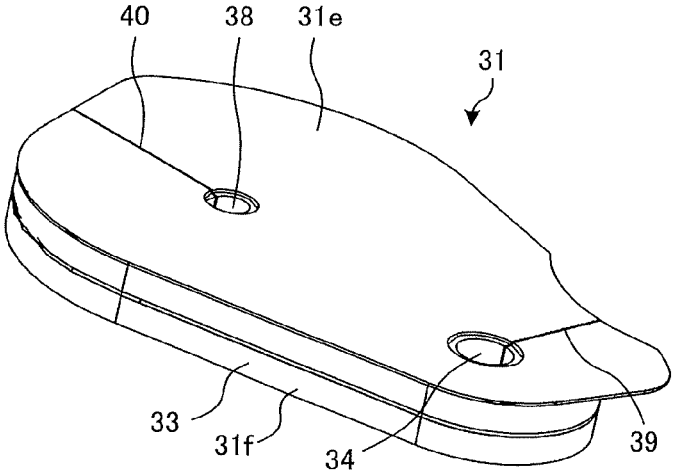
FIG. 15 is a perspective view of the top cover according to Embodiment 2 of the present invention.

FIG. 13 is a perspective view illustrating a top cover 31 according to Embodiment 2 of the present invention after attachment of the top cover 31. FIG. 14 is an enlarged perspective view illustrating a compressor 1 with the top cover 31 according to Embodiment 2 of the present invention, with the top cover 31 attached to the compressor 1. FIG. 15 is a perspective view of the top cover 31 according to Embodiment 2 of the present invention. It should be noted that with respect to Embodiment 2, only the features of Embodiment 2 will be described, and descriptions of components and configurations that are the same as or similar to those of Embodiment 1 will be omitted.

As illustrated in FIGS. 13 and 14, a soundproofing cover 30 includes the top cover 31 and a side cover 32. The top cover 31 is an integrated cover including an inner cover 33 as a lower layer in the top cover 31. In the top cover 31, an outer peripheral edge of the top cover 31 is located outward of an outer peripheral portion of the side cover 32, which covers a side peripheral portion of the compressor 1. The lower layer 31*f* of the top cover 31, which is the inner cover 33, is smaller than the upper layer 31*e*, and an outer peripheral portion of the lower layer 31*f* is thus formed to fit in an outer peripheral portion of the upper layer 31*e*.

As illustrated in FIG. 14, the side cover 32 has upper ends 32*a* and 32*b* located at different levels. To be more specific, the upper end 32*a* corresponds to a half of a peripheral portion of the side cover 32, and the upper end 32*b* corresponds to the other half of the peripheral portion of the side cover 32; and the upper end 32*a* is formed as a higher-level upper end 32*a* located at a higher level than the upper end 32*b*, and the upper end 32*b* is formed as a lower-level upper end 32*b*. Between the higher-level upper end 32*a* and the lower-level upper end 32*b*, a step 32*c* is formed.

As illustrated in FIG. 14, in the top cover 31, a first slope 31*a* is formed in such a manner as to be located on both the higher-level upper end 32*a* and the lower-level upper end 32*b* of the side cover 32, which are located at the difference levels. The first slope 31*a* is inclined toward a drain exhaust passage 13*a* of a base 13.

The top cover 31 includes two layers: an rubber sheet that is exposed to the outside and corresponds to the upper layer 31*e*, and a felt sheet that corresponds to the lower layer 31*f* of the top cover 31 and the inner cover 33. The felt sheet corresponding to the lower layer 31*f* is provided as the lower layer 31*f* underlying the rubber sheet corresponding to the upper layer 31*e*. An outer peripheral portion of the rubber sheet corresponding to the upper layer 31*e* is located outward of an outer peripheral portion of the felt sheet corresponding to the lower layer 31*f*.

The rubber sheet corresponding to the upper layer 31*e* serves as a sound insulating portion. The felt sheet corresponding to the lower layer 31*f* serves as a sound absorbing portion.

As illustrated in FIG. 15, the top cover 31 has a first hole portion 34 that surrounds a refrigerant pipe 25 extending upwards from the compressor 1. The top cover 31 has a third cut portion 39 provided between the first hole portion 34 and the outer peripheral side. The third cut portion 39 is a linear cut.

The top cover 31 further has a second hole portion 38 that surrounds a discharge pipe 26 extending upwards from the compressor 1. The top cover 31 has a fourth cut portion 40 provided between the second hole portion 38 and the outer peripheral side. The fourth cut portion 40 is a linear cut.

To attach the top cover 31, the refrigerant pipe 25 is made to pass through the third cut portion 39 such that the first hole portion 34 surrounds the refrigerant pipe 25, and the discharge pipe 26 is made to pass through the fourth cut portion 40 such that the second hole portion 38 surrounds the discharge pipe 26.

<Advantages of Embodiment 2>

According to Embodiment 2, the side cover 32 has the upper ends 32*a* and 32*b* located at the different levels. In the top cover 31, the first slope 31*a* is provided on both the upper ends 32*a* and 32*b* of the side cover 32 that are located at the different levels.

In in the above configuration, the top cover 31 can be handled as a separate component independent of the side cover 32. Thereby, attachment and detachment of the top cover 31 can be easily performed, thus improving the workability. Furthermore, it is possible to easily adjust the gradient of the first slope 31*a*, which guides liquid dropping onto the top cover 31 from the upper region. In addition, the top cover 31 can be easily separated from the other cover when discarded, and is thus environmentally friendly. Also, ordinarily, the top cover 31 is not affected by the change of the size or shape of the compressor 1. Therefore, the top cover 31 can be used for different types of compressors 1, and can thus be used for a given kind of compressor 1 different from the above compressor 1, and a new top cover 31 does not need to be made as a specific one for the other kind of compressor 1. Furthermore, even if liquid such as dew condensation water on the refrigerant pipe 25 provided above the compressor 1 drops onto the top cover 31 from the upper region, the liquid is guided over the first slope 31*a* of the top cover 31 and is then exhausted. Thus, the above liquid is prevented by the top cover 31 from moistening the compressor 1. It is therefore possible to prevent the compressor 1 from rusting, thereby preventing false detection of a sensor that detects the temperature of a shell on the compressor 1 or occurrence of a failure at the sensor. Furthermore, the top cover 31 can obtain effects of sound insulation or sound absorption as in existing top covers.

According to Embodiment 2, the top cover 31 includes the two layers that are the rubber sheet and the felt sheet. The felt sheet is provided as the lower layer 31*f* underlying the rubber sheet. The outer peripheral portion of the rubber sheet is located outward of the outer peripheral portion of the felt sheet.

In the above configuration, the rubber sheet serves as the sound insulating portion, and the felt sheet serves as the sound absorbing portion. Although the felt sheet is capable of absorbing moisture, the felt sheet is provided as the lower layer 31*f* underlying the rubber sheet and does not absorb liquid. Liquid dropping onto the top cover 31 from the above region is guided over the surface of the first slope 31*a* of the top cover 31, which is a surface of the rubber sheet, and is then exhausted.

According to Embodiment 2, the top cover 31 has the first hole portion 34 that surrounds the refrigerant pipe 25 extending upwards from the compressor 1. The top cover 31 has the third cut portion 39 provided between the first hole portion 34 and the outer peripheral side. The third cut portion 39 is a linear cut.

In the above configuration, when the third cut portion 39 is opened, the first hole portion 34 is shaped capable of surrounding the refrigerant pipe 25 in order that the top cover 31 be attached. The third cut portion 39 is a linear cut. Both side portions of the third cut portion 39 are brought into tight contact with each other. Thereby, liquid guided over the first slope 31*a* is prevented from flowing into the region located under the top cover 31 through the third cut portion 39.

Embodiments 1 and 2 of the present invention may be combined, and may be applied to other parts.

REFERENCE SIGNS LIST

1 compressor,
2 four-way valve,
3 outdoor heat exchanger,
4 expansion valve,
5 indoor heat exchanger,
6 outdoor fan,
7 cross-flow fan,
8 refrigerant pipe,
9 indoor unit,
10 outdoor unit,
11 casing,
12 top panel,
13 base,
13*a* drain exhaust passage,
14 front panel,
15 service panel,
16 right side panel,
17 left side panel,
18 cover panel,
19 cover panel,
20 air-sending device chamber,
21 machine chamber,
22 separator,
23 pressure vessel,
24 fan motor,
25 refrigerant pipe,
26 discharge pipe,
30 soundproofing cover,
31 top cover,
31*a* first slope,
31*b* portion to be made to overlap lower portion,
31*c* portion which upper portion is to be made to overlap,
31*d* slope,
31*e* upper layer,
31*f* lower layer,
32 side cover,
32*a* higher-level upper end,
32*b*, lower-level upper end,
32*c* step,
33 inner cover,
34 first hole portion,
35 first cut portion,
36*a* hook-and-loop fastener,
36*b* hook-and-loop fastener,
37 notch,
38 second hole portion,
39 third cut portion,
40 fourth cut portion,
100 air-conditioning apparatus,
A1 imaginary line,
A2 imaginary line,
A3 imaginary line

The invention claimed is:

1. A compressor cover comprising:

a side cover configured to surround a side peripheral surface of a compressor; and a top cover provided above the compressor and configured to cover along with the side cover, the compressor, wherein the top cover has a first slope that extends such that an outer peripheral side of the top cover is located lower than a central portion of the top cover, wherein the top cover has a first hole portion configured to surround a refrigerant pipe extending upwards from the compressor and a first cut portion provided between the first hole portion and the outer peripheral side, the refrigerant pipe being located on a lower-pressure side of the compressor and allowing refrigerant to flow into the compressor, and the first slope is formed by causing both side portions of the first cut portion of the top cover to overlap each other, wherein the outer peripheral side of the top cover is located outward of an outer peripheral portion of the side cover, and wherein the top cover has a notch in a region that is different from a region including the first slope and that contacts a discharge pipe extending upwards from the compressor, the notch being formed to bare a part of an upper face of the compressor in a state where the top cover is attached to the compressor.

2. The compressor cover of claim 1, wherein the first cut portion has a gap between the opposite sides on the outer peripheral side, while the both side portions of the first cut portion do not overlap each other.

3. The compressor cover of claim 1, wherein in the top cover, an imaginary line inclined at a maximum tilt angle relative to a horizontal plane, which extends between the first hole portion of the first slope and the outer peripheral side, is located in an area of a lower one of the both side portions of the first cut portion when the both side portions of the first cut portion overlap each other, the area of the lower side portion including an area where a boundary between the overlapping side portions of the first cut portion is located.

4. The compressor cover of claim 1, wherein the first slope is configured to guide liquid received by the top cover toward a drain exhaust passage of a bottom plate of a casing, on which the compressor is provided.

5. The compressor cover of claim 1, wherein the top cover is formed of a hydrophobic or water-repellent material.

6. The compressor cover of claim 1, wherein the top cover includes a pair of hook-and-loop fasteners on the both side portions of the first cut portion, the pair of hook-and-loop fasteners being used when the both side portions of the first cut portion are caused to overlap each other to form the first slope.

7. The compressor cover of claim 6, wherein the pair of hook-and-loop fasteners are formed to extend along edge portions of the first cut portion and each have a length greater than or equal to half each of the lengths of the edge portions, the edge portions extending between the first hole portion (34) and the outer peripheral side.

8. The compressor cover of claim 1, wherein the side cover has upper ends located at different levels, and wherein in the top cover, the first slope is formed in such a manner as to be located on both the upper ends of the side cover that are located at the different levels.

9. The compressor cover of claim 8, wherein the top cover includes two layers that are a rubber sheet and a felt sheet, wherein the felt sheet serves as a lower layer underlying the rubber sheet, and wherein the rubber sheet has an outer peripheral portion located outward of an outer peripheral portion of the felt sheet.

10. An outdoor unit of an air-conditioning-apparatus, comprising the compressor cover of claim 1.

11. The air-conditioning apparatus comprising the outdoor unit of claim 10.

* * * * *